US011337571B2

(12) United States Patent
Gu et al.

(10) Patent No.: US 11,337,571 B2
(45) Date of Patent: May 24, 2022

(54) VACUUM CLEANER

(71) Applicant: BISSELL Homecare, Inc., Grand Rapids, MI (US)

(72) Inventors: Yong Jian Gu, Guang Dong (CN); Ying Chun Wong, Hong Kong (CN)

(73) Assignee: BISSELL Inc., Grand Rapids, MI (US)

( * ) Notice: Subject to any disclaimer, the term of this patent is extended or adjusted under 35 U.S.C. 154(b) by 441 days.

(21) Appl. No.: 16/367,898

(22) Filed: Mar. 28, 2019

(65) Prior Publication Data

US 2019/0216278 A1 Jul. 18, 2019

Related U.S. Application Data

(63) Continuation of application No. 15/891,703, filed on Feb. 8, 2018, now Pat. No. 10,285,548, which is a continuation of application No. 14/741,836, filed on Jun. 17, 2015, now Pat. No. 9,924,842.

(60) Provisional application No. 62/019,122, filed on Jun. 30, 2014.

(51) Int. Cl.

| | |
|---|---|
| ***A47L 5/30*** | (2006.01) |
| ***A47L 9/32*** | (2006.01) |
| ***A47L 9/02*** | (2006.01) |
| ***A47L 9/28*** | (2006.01) |

(52) U.S. Cl.

CPC ..... *A47L 5/30* (2013.01); *A47L 9/02* (2013.01); *A47L 9/2857* (2013.01); *A47L 9/325* (2013.01)

(58) Field of Classification Search

CPC . A47L 5/30; A47L 9/02; A47L 9/2857; A47L 9/325

See application file for complete search history.

(56) References Cited

U.S. PATENT DOCUMENTS

| | | | | | |
|---|---|---|---|---|---|
| 3,079,626 | A | | 3/1963 | Anderson | |
| 3,277,512 | A | * | 10/1966 | Waters | A47L 5/32 15/339 |
| 3,758,914 | A | | 9/1973 | Hilmanowski | |
| 3,936,905 | A | * | 2/1976 | Stewart | A47L 9/0072 15/416 |
| 3,942,219 | A | * | 3/1976 | Johnson | A47L 9/04 15/383 |
| 4,499,628 | A | * | 2/1985 | Platt | A47L 9/02 15/416 |
| RE32,751 | E | * | 9/1988 | Joss | A47L 5/24 15/329 |
| 5,996,175 | A | * | 12/1999 | Fusco | A46B 5/0075 15/144.1 |
| 6,039,817 | A | * | 3/2000 | Payne | A47L 5/28 134/21 |
| 6,099,661 | A | * | 8/2000 | Conrad | A47L 5/30 134/21 |

(Continued)

FOREIGN PATENT DOCUMENTS

| | | |
|---|---|---|
| CN | 201493298 U | 6/2010 |
| DE | 2610866 A1 | 9/1977 |

(Continued)

*Primary Examiner* — Marc Carlson

(74) *Attorney, Agent, or Firm* — McGarry Bair PC

(57) ABSTRACT

A surface cleaning apparatus includes a base unit configured to be moved over a surface to be cleaned, an upper unit coupled with the base unit, and a handle coupled with the upper unit and moveable between a folded position and an upright position.

19 Claims, 15 Drawing Sheets

(56) References Cited

U.S. PATENT DOCUMENTS 6,514,356 B2 * 2/2003 Vystrcil ..... A47L 5/28 134/21
6,779,229 B2 * 8/2004 Lee ..... A47L 9/00 15/329
6,941,615 B2 * 9/2005 Shanor ..... A47L 9/325 15/339
7,219,390 B2 5/2007 Johnson
7,278,181 B2 * 10/2007 Harris ..... A47L 9/02 15/353
7,281,298 B2 * 10/2007 Joung ..... A47L 9/325 15/410
7,383,609 B2 * 6/2008 Ji ..... A47L 9/325 15/410
7,496,984 B2 * 3/2009 Pang ..... A47L 9/242 15/144.1
7,681,279 B2 * 3/2010 Kelly ..... A47L 9/325 15/323
8,020,251 B2 * 9/2011 Luebbering ..... A47L 9/2842 15/410
8,028,373 B2 * 10/2011 Rowntree ..... A47L 9/322 15/347
8,424,156 B2 * 4/2013 Hsu ..... A47L 7/04 15/382
8,813,297 B2 * 8/2014 Rosenzweig ..... B25G 1/06 15/144.1
9,125,538 B2 * 9/2015 Paliobeis ..... A47L 9/325
9,215,960 B2 * 12/2015 Conrad ..... A47L 9/106
9,386,895 B2 * 7/2016 Conrad ..... A47L 5/32
2010/0229315 A1 * 9/2010 Rosenzweig ..... B25G 3/38 15/144.1
2014/0026353 A1 * 1/2014 Paliobeis ..... A47L 9/325 15/410
2015/0101144 A1 * 4/2015 Bosses ..... A47L 5/28 15/332
2015/0374184 A1 * 12/2015 Gu ..... A47L 5/30 15/324
2018/0160870 A1 * 6/2018 Gu ..... A47L 5/30
2019/0216278 A1 * 7/2019 Gu ..... A47L 5/30

FOREIGN PATENT DOCUMENTS

EP 1033101 A2 9/2000
GB 2336523 A1 10/1999
GB 2378643 A1 2/2003

* cited by examiner

VACUUM CLEANER

CROSS REFERENCE TO RELATED APPLICATIONS

This application is a continuation of U.S. patent application Ser. No. 15/891,703, filed Feb. 8, 2018, now U.S. Pat. No. 10,285,548, issued May 14, 2019, which is a continuation of U.S. patent application Ser. No. 14/741,836, filed Jun. 17, 2015, now U.S. Pat. No. 9,924,842, which claims the benefit of U.S. Provisional Patent Application No. 62/019,122, filed Jun. 30, 2014, all of which are incorporated herein by reference in their entirety.

BACKGROUND

Vacuum cleaners typically have one main suction nozzle in fluid communication with a source of suction. The main suction nozzle therefore forms an inlet for a working airstream that transports dirt and other debris into the vacuum cleaner. Vacuum cleaners also have been provided with edge cleaning nozzles for cleaning along baseboards or perimeter edges of rooms, at the junction of the floor and wall, and near kick plates of cabinetry and appliances. The edge cleaning nozzles can be configured to direct at least a portion of the working airstream toward a side or edge of the vacuum cleaner to achieve better edge cleaning. Vacuum cleaners also typically have a handle for a user to grip. In some cases, the handle may be foldable to reduce the amount of storage space required when the vacuum cleaner is not in use.

BRIEF DESCRIPTION

An aspects of the present disclosure relates to a surface cleaning apparatus including a base unit configured to be moved over a surface to be cleaned, an upper unit coupled with the base unit, a handle coupled with the upper unit and configured for use in facilitating movement of the surface cleaning apparatus over the surface to be cleaned, a handle coupler pivotally coupling a proximal end of the handle with the upper unit for selective movement of the handle about a horizontal axis defined by the handle coupler between an upright position and a folded position where the handle coupler is moveable between a first position to allow the handle to rotate about the horizontal axis into the folded position and a second position to lock the handle in the upright position, and an actuator operably coupled to the handle coupler and disposed on the handle at a location spaced from the proximal end of the handle, the actuator accessible by a user of the surface cleaning apparatus for selectively moving the handle coupler between the first and second positions.

DETAILED DESCRIPTION

Aspects of the present disclosure relates to surface cleaning apparatus and in particular to vacuum cleaners. For purposes of description related to the figures, the terms "upper," "lower," "right," "left," "rear," "front," "vertical," "horizontal," and derivatives thereof shall relate from the perspective of a user in a typical operating position behind the vacuum cleaner, which defines the rear of the vacuum cleaner. However, it is to be understood that aspects of the present disclosure may assume various alternative orientations, except where expressly specified to the contrary.

Figure 1:
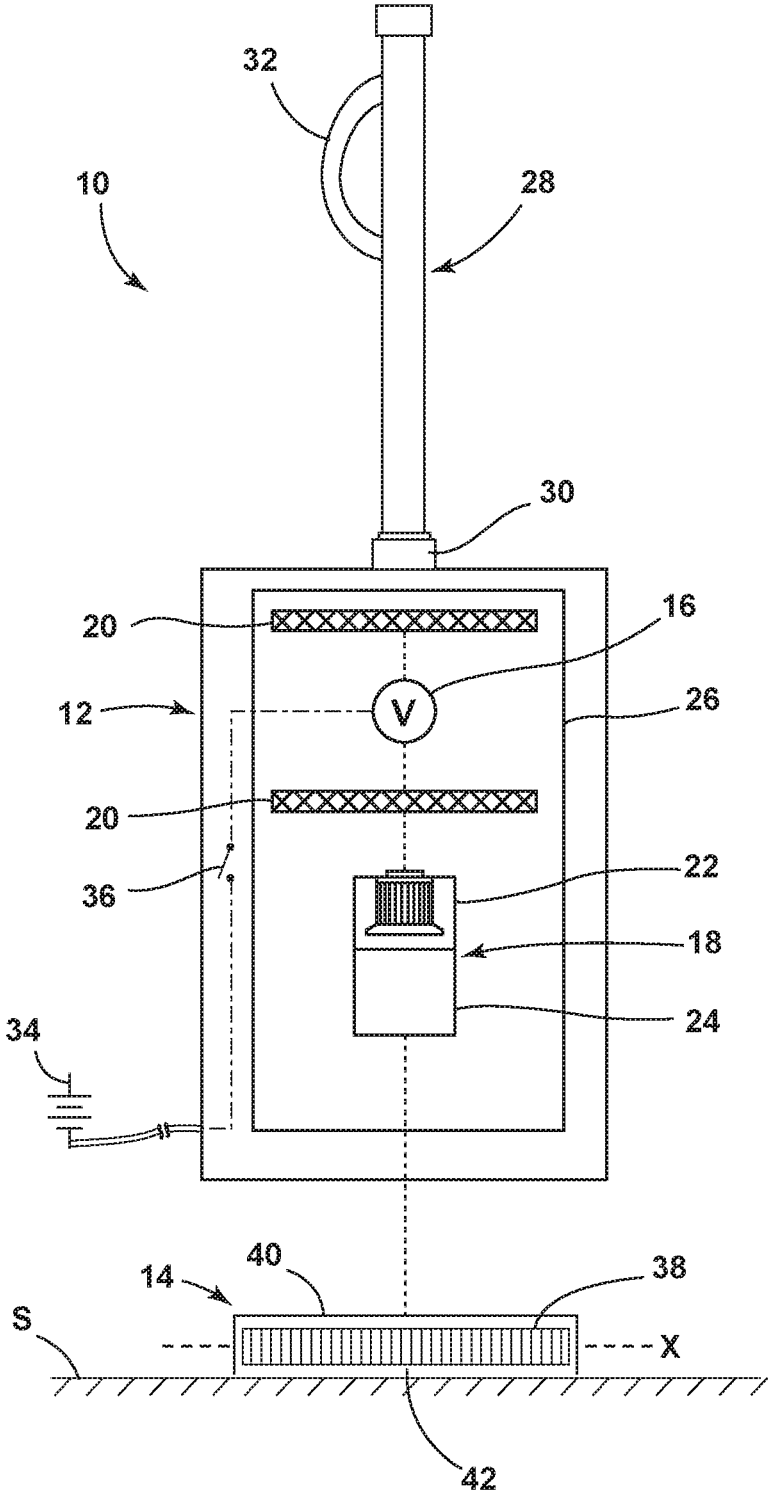
FIG. 1 is a schematic view of a vacuum cleaner according to aspects of the present disclosure.
Figure 2:
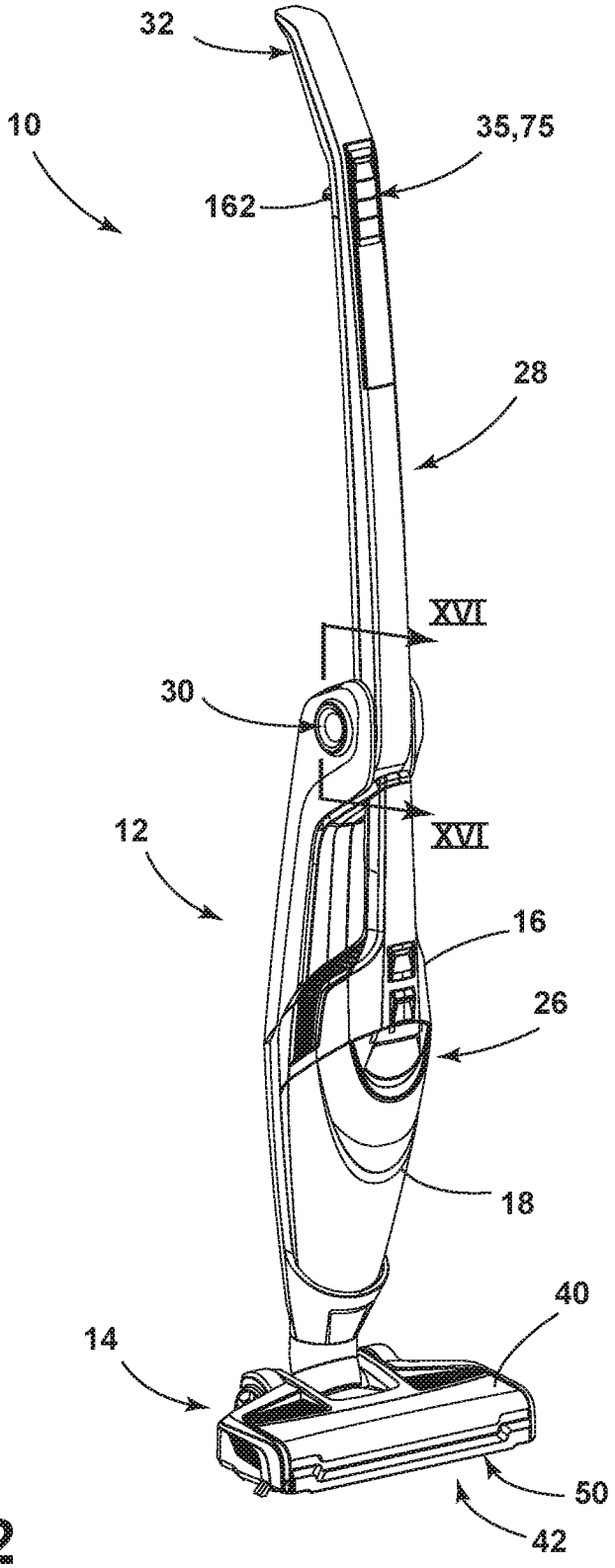
FIG. 2 is a perspective view of the vacuum cleaner of FIG. 1.

Referring now to FIG. 1 and FIG. 2, there is shown a schematic view of a vacuum cleaner 10 and a perspective view of the vacuum cleaner 10, respectively, according to aspects of the present disclosure. The vacuum cleaner 10 is shown herein as a stick-type vacuum cleaner, with a housing comprising an upper unit 12 coupled with a base unit 14 adapted to be moved over a surface to be cleaned S. The vacuum cleaner 10 can alternatively be configured as an upright-type vacuum cleaner, a canister-type vacuum cleaner, or a hand-held vacuum cleaner. Furthermore, the vacuum cleaner 10 can additionally be configured to distribute a fluid and/or to extract a fluid, where the fluid may for example be liquid or steam.

The upper unit 12 is pivotally mounted to the base unit 14 for movement between an upright storage position, shown in FIG. 2, and a reclined use position (not shown). The vacuum cleaner 10 can be provided with a detent mechanism, such as a pedal pivotally mounted to the base unit 14, for selectively releasing the upper unit 12 from the storage position to the use position. The details of such a detent pedal are known in the art, and will not be discussed in further detail herein.

The upper unit 12 can include a vacuum collection system for creating a partial vacuum to suck up debris (which may include dirt, dust, soil, hair, and other debris) from the surface to be cleaned S and collecting the removed debris in a space provided on the vacuum cleaner 10 for later disposal.

The upper unit 12 includes a suction source 16 in fluid communication with the base unit 14 for generating a working airstream and a separating and collection assembly 18 for separating and collecting debris (which can be solid, liquid, or a combination thereof) from the working airstream for later disposal. The upper unit 12 further includes a handle 28 to facilitate movement of the vacuum cleaner 10 by a user. A handle coupler 30 can receive the proximal end of the handle 28, which may be fixed with respect to the upper unit 12, or may pivot to allow the handle 28 to rotate or fold about a horizontal axis relative to the upper unit 12. As illustrated, the handle 28 is pivotally mounted to the upper unit 12 via handle coupler 30 for movement between an upright position, shown in FIG. 2, and a folded position, shown in FIG. 13. The handle 28 may further comprise the power switch 36 as well as other controls and indicators used during operation. The handle 28 may further comprise a handle grip 32 opposite the handle coupler 30.

In one configuration illustrated herein, the collection assembly 18 can include a cyclone separator 22 for separating contaminants from a working airstream and a removable debris cup 24 for receiving and collecting the separated contaminants from the cyclone separator 22. The cyclone separator 22 can have a single cyclonic separation stage, or multiple stages. In another configuration, the collection assembly 18 can include an integrally formed cyclone separator 22 and debris cup 24, with the debris cup 24 being provided with a structure, such as a bottom-opening debris door, for contaminant disposal. It is understood that other types of collection assemblies 18 can be used, such as a centrifugal separator, a bulk separator, a filter bag, or a water-bath separator. The upper unit 12 can also be provided with one or more additional filters 20 upstream or downstream of the separating and collection assembly 18 or the suction source 16.

The suction source 16, such as a motor/fan assembly, is provided in fluid communication with the separating and collection assembly 18, and can be positioned downstream or upstream of the separating and collection assembly 18. The suction source 16 can be electrically coupled to a power source 34, such as a battery or by a power cord plugged into a household electrical outlet. A suction power switch 36 disposed between the suction source 16 and the power source 34 can be selectively closed by the user upon pressing a vacuum power button 35, thereby activating the suction source 16. As shown herein, the suction source 16 is downstream of the separating and collection assembly 18 for a 'clean air' system; alternatively, the suction source 16 can be upstream of the separation and collection assembly 18 for a 'dirty air' system.

In another configuration, the separation and collection assembly 18, suction source 16, filters 20, power source 34 and power switch 36 may all be disposed within a removable hand-held unit 26 which is removable from the upper unit 12. When disposed in the upper unit 12, the hand-held unit 26 provides the separation and collection assembly 18, suction source 16, filters 20 and power source 34 for the vacuum cleaner 10. When removed from the upper unit 12, the hand-held unit 26 may operate independently from the upper unit 12 to create partial vacuum to suck up debris (which may include dirt, dust, soil, hair, and other debris) from the surface to be cleaned S. It is noted that features of the present disclosure may be applicable to vacuum cleaners not having a hand-held unit.

The base unit 14 is in fluid communication with the suction source 16 for engaging and cleaning the surface to be cleaned S. The base unit 14 includes a base housing 40 having a suction nozzle 42 at least partially disposed on the underside and front of the base housing 40. The base housing 40 can secure an agitator 38 within the base unit 14 for agitating debris on the surface to be cleaned S so that the debris is more easily ingested into the suction nozzle 42. Some examples of agitators 38 include, but are not limited to, a rotatable brushroll, dual rotating brushrolls, or a stationary brush. The agitator 38 illustrated herein is a rotatable brushroll positioned within the base unit 14 adjacent the suction nozzle 42 for rotational movement about an axis X, and can be coupled to and driven by a dedicated agitator motor provided in the base unit 14 via a commonly known arrangement including a drive belt. Alternatively, the agitator 38 can be coupled to and driven by the suction source 16 in the upper unit 12. It is within the scope of aspects of the present disclosure for the agitator 38 to be mounted within the base unit 14 in a fixed or floating vertical position relative to the base unit 14.

The vacuum cleaner 10 can be used to effectively clean the surface to be cleaned S by removing debris (which may include dirt, dust, soil, hair, and other debris) from the surface to be cleaned S in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from aspects of the present disclosure.

To perform vacuum cleaning in the canister configuration shown in FIG. 1, the suction source 16 is coupled to the power source 34 and draws in debris-laden air through the base unit 14 and into the separating and collection assembly 18 where the debris is substantially separated from the working air. The air flow then passes through the suction source 16, and through any optional filters 20 positioned upstream and/or downstream from the suction source 16, prior to being exhausted from the vacuum cleaner 10. During vacuum cleaning, the agitator 38 can agitate debris on the surface to be cleaned S so that the debris is more easily ingested into the suction nozzle 42. The separating and collection assembly 18 can be periodically emptied of debris. Likewise, the optional filters 20 can periodically be cleaned or replaced.

Figure 3:
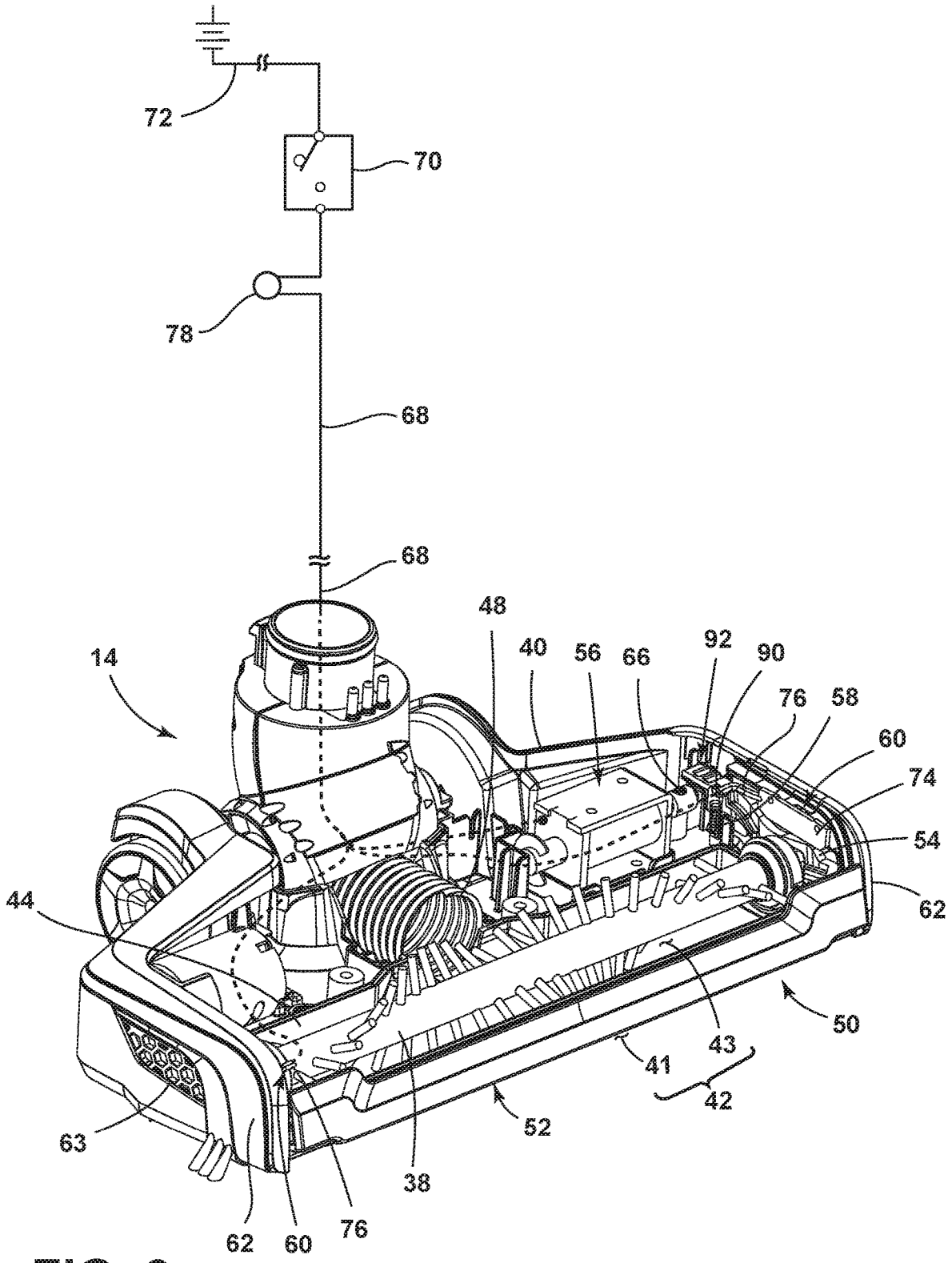
FIG. 3 is a perspective view the base unit of FIG. 2 with portions removed according to an aspect of the present disclosure.

FIG. 3 is the base unit 14 from FIG. 2 according to an aspect of the present disclosure with portions of the base housing 40 removed. The base housing 40 encloses components of the base unit 14 to create a partially enclosed space therein. The agitator 38 is provided at a forward portion of the base housing 40. The base housing 40 can also include a sole plate 44 fastened to the underside of the base housing 40 to secure the agitator 38 within the base housing 40 and define the suction nozzle 42.

The suction nozzle 42 comprises a suction nozzle opening defined by an underside suction nozzle opening 43 formed in the underside of the sole plate 44 and a front suction nozzle opening 41 formed in the front of the sole plate 44 and front the base housing 40. The suction nozzle openings 41, 43 are in fluid communication with a duct 48 coupled at one end to the base housing 40, which fluidly communicates the suction nozzle openings 41, 43 with the collection assembly 18 (FIG. 2). It will be understood that the underside suction nozzle opening 43 and the front suction nozzle opening 41 may be formed from a single opening in the sole plate 44 and may be considered to be a single opening. Alternatively, the suction nozzle openings 41, 43 may be considered to be separate openings wherein the suction nozzle 42 may be provided with at least one of the underside suction nozzle opening 43 or the front suction nozzle opening 41.

Figure 4:
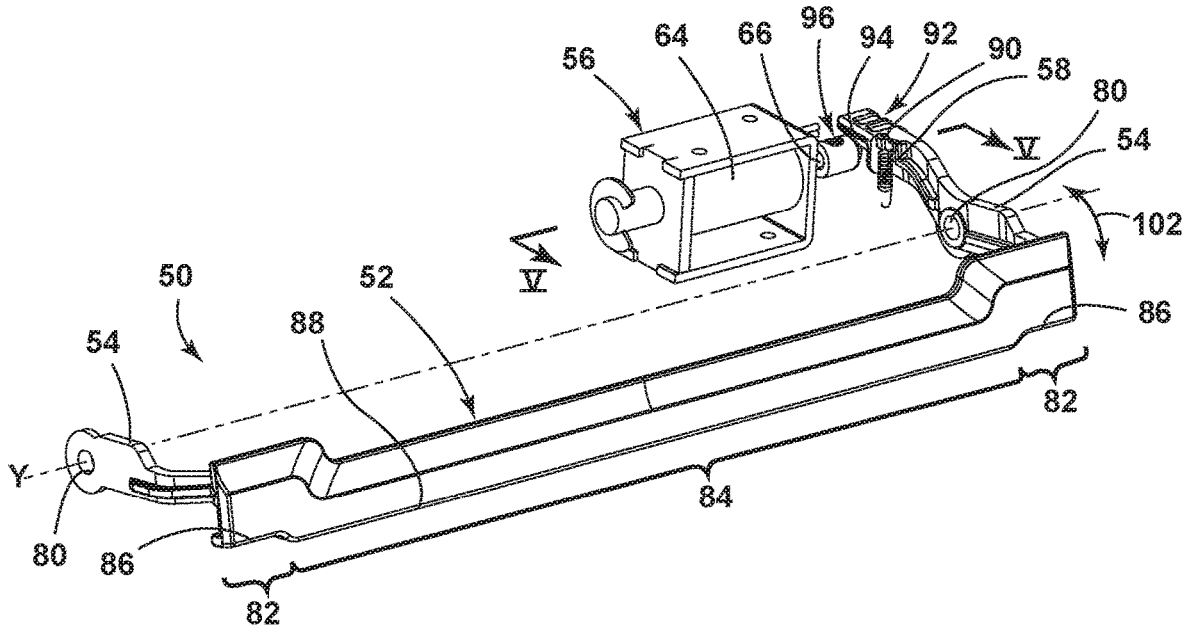
FIG. 4 is a is a perspective view of the diverter assembly of FIG. 3 with portions removed.

Referring now to FIGS. 3-4, the base unit 14 can further include a suction nozzle opening diverter assembly 50 comprising a diverting member 52, two pivoting members 54, a solenoid piston 56, a diverter biasing spring 58 and edge illuminators 60 configured to selectively restrict a portion of the suction nozzle 42 and provide illumination when the restricting occurs. The diverter member 52 extends along the front of the base housing 40 between the front vertical edges of two vertical side walls 62 with a middle portion bottom edge 88 of the diverter member 52 defining the upper boundary of the front suction nozzle opening 41 and the upper edge of the diverter member 52 in communication with a front portion of the base housing 40 (best seen in FIGS. 9 and 10). Opposing diverter member ends 82 are elevated upward with respect the diverter member middle 84 such that the end portion bottom edges 86 of the diverter member ends 82 are elevated higher than the middle portion bottom edge 88 of the diverter member middle 84.

The two pivoting members 54 extend substantially perpendicularly from the diverter member 52 along the sides of the base housing 40 towards the rear of the base housing 40. The pivoting members 54 are provided with an aperture 80 that receives a horizontal pin (not shown) disposed in the base housing 40 for pivotally mounting the pivoting members 54 to the base housing 40 wherein the two apertures 80 axially align, defining a pivot axis Y. Alternatively, a pin may be provided on the pivoting members 54 and an aperture for receiving the axles in the base housing 40. The rear end of at least one pivoting members 54 is further provided with a spring mount 90 and a diverter end portion 92 having an inverted diverter end wedge 94 disposed on the lower side of the diverter end portion 92 sloping upwardly towards the solenoid piston 56.

The solenoid piston 56 is disposed in the rear of the base housing 40 and is configured to selectively engage at least one of the pivoting members 54. The solenoid piston 56 is of conventional design and comprises a stationary housing 64 having an inductive coil (not shown) mounted therein, connected to a power supply, and configured to surround a piston 66 having a cone-shaped termination cap 96. The solenoid piston 56 is selectively movable between a horizontally extended position and a retracted position when the inductive coil is alternately energized and de-energized wherein the termination cap 96 is in communication with the diverter end wedge 94 of the diverter end portion 92 when extended and not in communication when retracted.

The edge illuminators 60 are mounted in the base housing 40 along the two vertical side walls 62 behind light transmitting screens 63 which may form a portion of the vertical side walls 62 such that light illuminated from the edge illuminators 60 pass through the light transmitting screens 63. The edge illuminators 60 can be selected from known constructions, including light emitting diodes (LED) or incandescent lamps, for example. The edge illuminators 60 are of conventional construction and comprise at least one lens (not shown), at least one light emitting element (LED) (not shown), a printed circuit board (PCB) 74 and electrical leads 76.

Referring now to FIGS. 2-3, electrical conductor leads 68 extend from the solenoid piston 56 and the edge illuminators 60 electrical leads 76, routing through the base unit 14 through the upper unit 12 and handle 28, and are connected to an electrical switch 70 housed in the handle 28. The electrical switch 70 is, in turn, connected to a power source 72 to selectively energize the solenoid piston 56 and edge illuminators 60. The electrical switch 70 may be operatively coupled to a conventional push button 75 disposed in the front portion of the handle 28 as illustrated or a toggle or "rocker" switch (not shown) as is commonly known in the art such that it becomes selectively engaged when a user engages the push button 75.

An optional visual indicator, such as an indicator light 78, may be mounted to upper portion of the handle 28 for indicating when the solenoid piston 56 and edge illuminators 60 have been activated. The indicator light 78 can be selected from known constructions, including light emitting diodes (LED) or incandescent lamps, for example. The indicator light 78 is of conventional construction and comprises a lens (not shown), a light emitting element (LED) (not shown), and electrical leads (not shown) connected in series with the electrical switch 70, solenoid piston 56 and edge illuminators 60.

Figure 5:
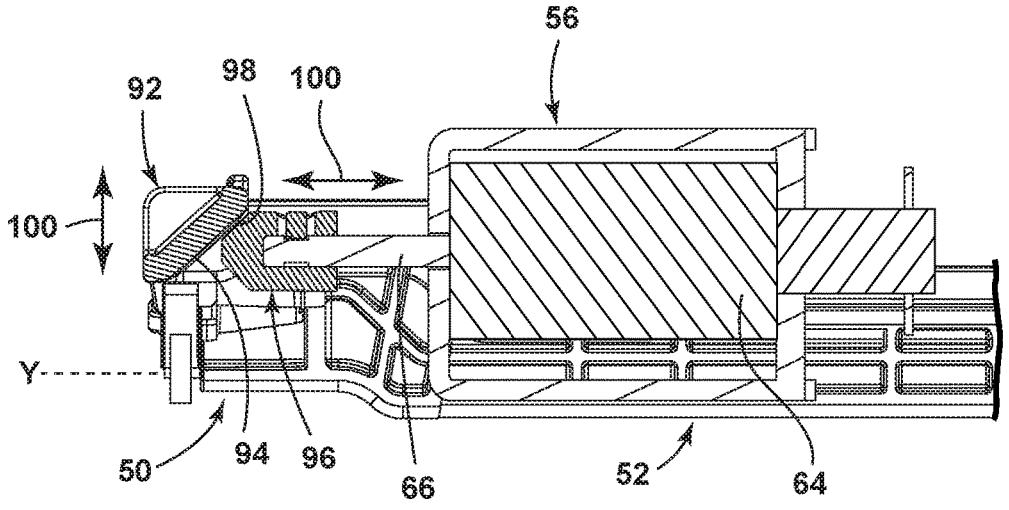
FIG. 5 is a cross-sectional view through line V-V of FIG. 4 with portions removed.

FIG. 5 shows a cross section of the diverter assembly 50 and solenoid piston 56 of FIG. 4 taken along line V-V and more clearly illustrates the interaction between the termination cap 96 and the diverter end wedge 94. The cone shape of the termination cap 96 forms a piston wedge 98 sloping towards the diverter end portion 92. The piston wedge 98 is in register with, but does not fully engage the diverter end wedge 94 when the piston 66 of the solenoid piston 56 is in the retracted position as illustrated. When the piston 66 is extended, the piston wedge 98 engages the diverter end wedge 94.

The piston wedge 98 converts the horizontal force of the piston 66 into a force perpendicular to the piston wedge 98 having horizontal and vertical components and imparts it to the diverter end wedge 94. As the piston 66 extends, the diverter end wedge 94 and piston wedge 98 slip relative to each other such that the diverter end portion 92 pivots upward about the pivot axis Y. When the piston 66 is again retracted, the piston wedge 98 and the diverter end wedge 94 disengage and the diverter end portion 92 pivots downwards due to the tension force of the diverter biasing spring 58 shown in FIG. 4. The movement of the piston 66 and diverter end portion 92 are schematically illustrated by arrows 100. It will be understood that the forces imparted on the diverter end wedge 94 by the solenoid piston 56 when the piston 66 is extended may be optimized to overcome all resistive forces such as friction, weight and spring tension in order provide for upward movement of the diverter end portion 92. It will also be understood that the diverter biasing spring 58 may have a spring rate that is optimized to overcome all resistive forces such as friction and weight in order to provide for downward movement of the diverter end portion 92 when the piston 66 is retracted.

Referring again to FIG. 4, the diverter member 52 is configured to selectively pivot about the pivot axis Y so as to move upwards and downwards to selectively restrict a portion of the suction nozzle 42, thereby increasing the suction force through the unrestricted portion, given that the same volume of air is being drawn through a smaller opening. The upward movement of the diverter end portion 92 caused by the piston 66 extending and the downward movement of the diverter end portion 92 caused by the diverter biasing spring 58 when the piston 66 is retracted causes the diverter assembly 50 to pivot about the pivot axis Y such that the diverter member 52 pivots downward and upward respectively as schematically illustrated by arrows 102.

Figure 6:
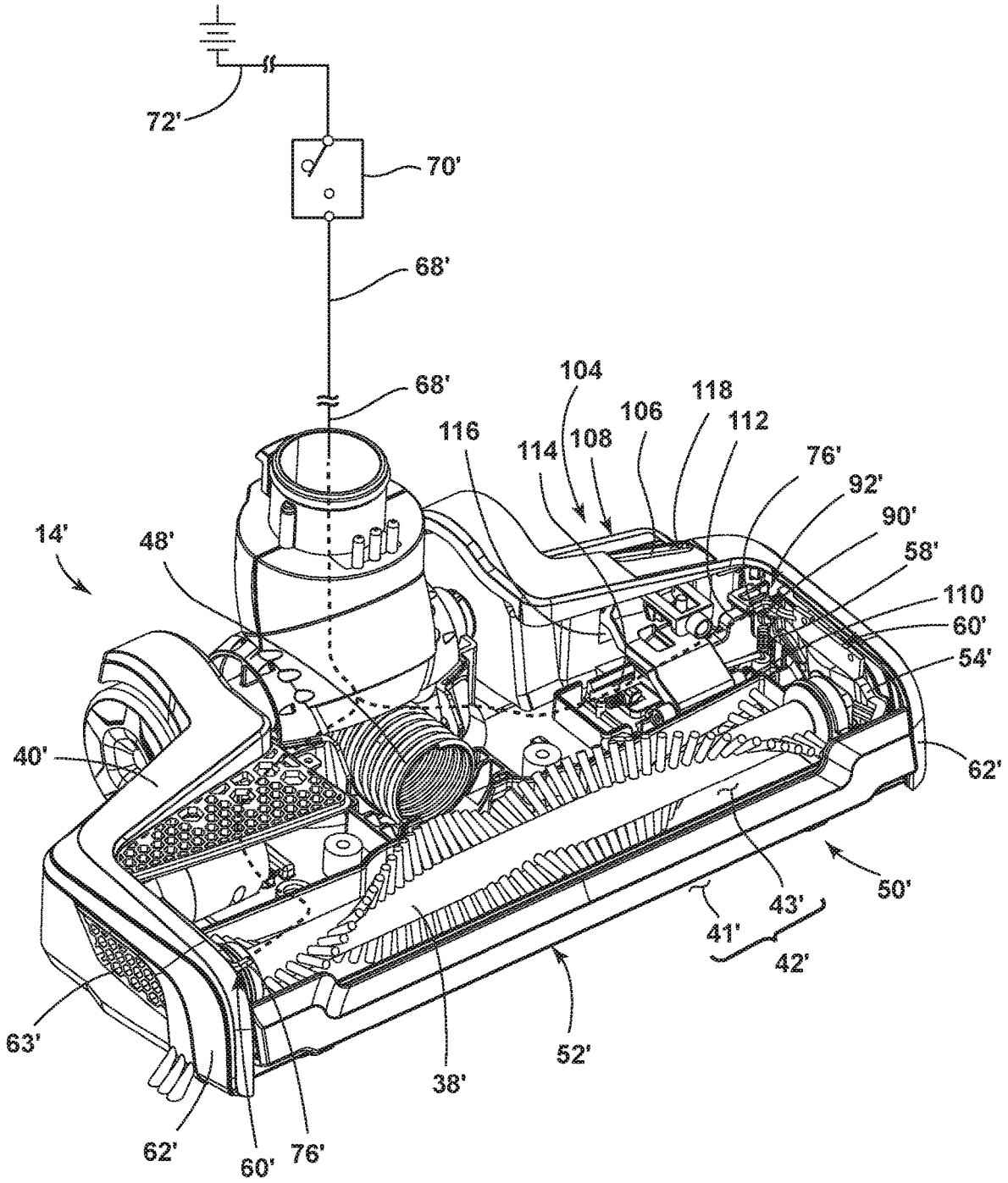
FIG. 6 is a perspective view the base unit of FIG. 2 with portions removed according to an aspect of the present disclosure.
Figure 7:
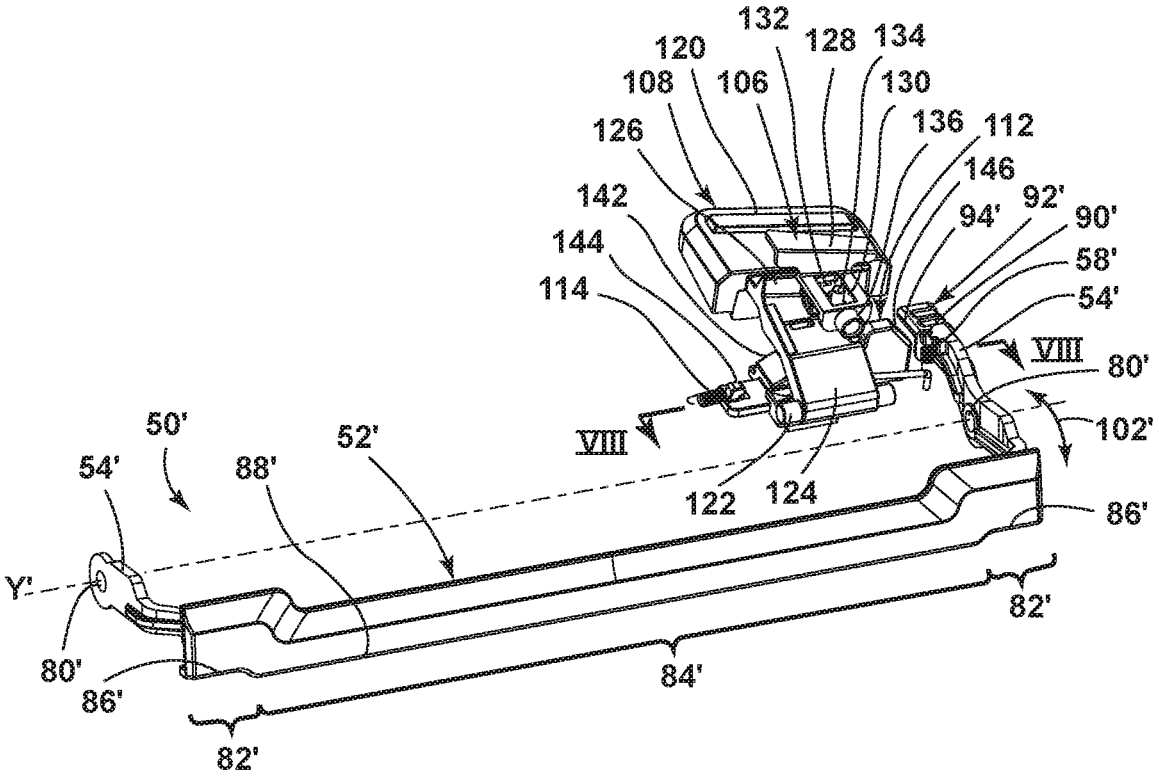
FIG. 7 is a is a perspective view of the diverter assembly of FIG. 6 with portions removed.

Referring to FIGS. 6-7, in an aspect of the present disclosure where like elements are identified with the same reference numerals and include a prime (') symbol, the solenoid piston 56 and indicator light 78 are replaced with a foot actuated pedal assembly 104. The pedal assembly 104 comprises a mode indicator 106, a pivoting pedal 108, a pedal biasing spring 110, a sliding wedge 112 and sliding wedge biasing spring 114. The pedal assembly 104 is disposed in the rear of the base housing 40' and is configured to selectively engage at least one of the pivoting members 54'. The base housing 40' may also include a pedal recess 116 formed in the rear vertical side of the base housing 40' such that a portion of the pedal 108 may pass through the pedal recess 116 as well as an indicator recess 118 formed in the rear of the upper horizontal side of the base housing 40' such that the indicator recess 118 may be selectively covered by a portion of the mode indicator 106.

The pivoting pedal 108 includes an actuating surface 120 connected to a cylindrical axle 122 by an arm member 124. The actuating surface 120 is configured to be depressed by a user's foot. The cylindrical axle 122 is pivotally mounted to the base housing 40' with the centerline of the cylindrical axle 122 substantially parallel to the pivot axis Y'. The arm member 124 extends between the actuating surface 120 and the cylindrical axle 122 such that the actuating surface 120 is disposed above and behind the cylindrical axle 122, and includes a vertical protrusion 126 extending upwards from the top surface of the arm member 124 adjacent to the actuating surface 120. The arm member 124 also includes an arm wedge 125 (shown in FIG. 8) provided on the underside of the arm member 124 which slopes toward the diverter end portion 92' of the pivoting member 54'.

The pivoting pedal 108 is configured to selectively rotate about the cylindrical axle 122 axis between an up position wherein the upper portion of the arm member 124 is in contact with the upper boundary of the pedal recess 116 and a down position wherein the lower surface of the arm member 124 is in contact with the lower boundary of the pedal recess 116. The pedal biasing spring 110 is attached to the cylindrical axle 122 and the base housing 40' and provides torsion to the cylindrical axle 122 so as to bias the pivoting pedal 108 to the up position. The pedal assembly 104 may further include a detent mechanism for selectively securing the pivoting pedal 108 in the down position. The details of such a detent mechanism are known in the art, and will not be discussed in further detail herein.

Figure 8:
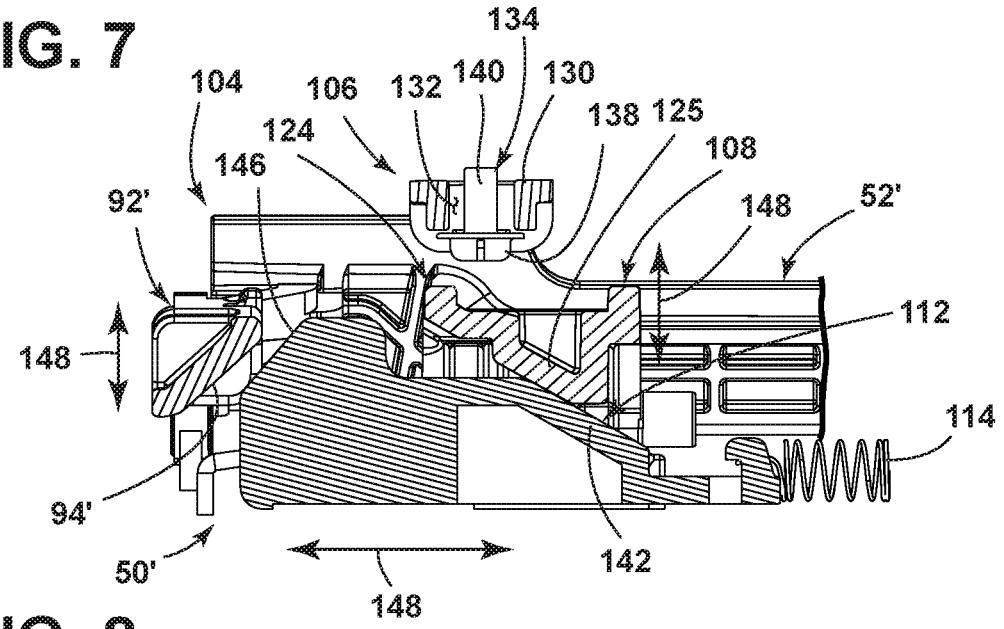
FIG. 8 is a cross-sectional view through line VIII-VIII of FIG. 7 with portions removed.

The mode indicator 106 includes an L-shaped indicating portion 128 connected to a body portion 130. The horizontal surface of the indicating portion 128 is configured to selectively cover the indicator recess 118 and the vertical surface of the indicating portion extends downward and connects to the rear of the body portion 130. The body portion 130 includes a guide slot 132 extending horizontally, perpendicular to the pivot axis Y'. As seen in FIG. 8, the guide slot 132 is configured to receive a stationary screw 134 wherein the screw head 138 abuts the underside of the body portion 130 and the screw shaft 140 extends through the guide slot 132 and attaches to the base housing 40' (not shown) to slidably secure the mode indicator 106 to the base housing 40'. The body portion 130 may further include a hollow cylindrical spring holder 136 (FIG. 7) configured to receive one end of an indicator biasing spring (not shown) wherein the other end of the spring is attached to the base housing 40'. The indicator biasing spring exerts a horizontal force on the mode indicator 106 such that the rear of the body portion 130 is biased against the forward portion of the vertical protrusion 126 (FIG. 7).

As the pivoting pedal 108 is pivoted to the down position, the vertical protrusion 126 pivots down and away from the mode indicator 106 allowing the mode indicator 106 to move towards the rear of the base housing 40' under the spring force of the indicator biasing spring (not shown) until the stationary screw 134 abuts the forward portion of the guide slot 132 such that the horizontal surface of the indicator portion 128 covers the indicator recess 118 formed in the base housing 40'. When the pivoting pedal 108 is returned to the up position, the vertical protrusion 126 engages the mode indicator 106 and moves it forward such that the horizontal surface of the indicating portion 128 does not cover the indicator recess 118.

The sliding wedge 112 forms an elongated structure extending parallel to the pivot axis Y' wherein one side of the sliding wedge 112 forms a sliding pedal wedge 142 and spring mount 144, and the opposing side forms a sliding diverter wedge 146. The sliding pedal wedge 142 slopes downwardly and away from the diverter end portion 92' and is disposed beneath the arm wedge 125 (FIG. 8) of the pivoting pedal 108. The sliding diverter wedge 146 slopes downwardly and towards the diverter end portion 92' and is adjacent to the diverter end wedge 94' of the diverter end portion 92'. The spring mount 144 is formed at the bottom of the sliding pedal wedge 142 and is configured to attach to one end of the sliding wedge biasing spring 114. The opposite end of the spring 114 is attached to the base housing 40'.

The sliding wedge 112 is configured to linearly slide along the bottom of the base housing 40' towards and away from the diverter end portion 92' along an axis parallel to the pivot axis Y'. The base housing 40' may include a track or guide to ensure a linear sliding path. The sliding wedge biasing spring 114 is configured to bias the sliding wedge 112 away from the diverter end portion 92'.

The switch 70' may be disposed in the base housing 40' wherein the switch is, in turn, connected to power source 72' to selectively energize edge illuminators 60'. The switch 70' may be configured such that actuating the pivoting pedal 108 to the down position energizes the edge illuminators 60'. Alternatively, a sensor may be provided in the base housing 40' to sense when the pivoting pedal 108 has been actuated and activate the switch 70', thereby energizing the edge illuminators 60'.

FIG. 8 shows a cross section of the diverter assembly 50' and pedal assembly 104 of FIG. 8 taken along line VIII-VIII of FIG. 7 and more clearly illustrates the interaction between the pivoting pedal 108, the sliding wedge 112 and the diverter end wedge 94' of the diverter end portion 92'. The arm wedge 125 on the pedal 108 is disposed above and in register, but not fully engaged with the sliding pedal wedge 142 when the pivoting pedal 108 is in the up position as illustrated. When the pivoting pedal 108 is depressed to the down position, the arm wedge 125 converts the downward force of the pivoting pedal 108 into a force perpendicular to the arm wedge 125 having horizontal and vertical components and imparts it to the sliding pedal wedge 142. As the pivoting pedal 108 travels downward, the arm wedge 125 and the sliding pedal wedge 142 slip relative to each other such that the sliding wedge 112 moves horizontally and the sliding diverter wedge 146 engages the diverter end wedge 94' of the diverter end portion 92'. The sliding diverter wedge 146 converts the horizontal force of the sliding wedge 112 into a force perpendicular to the piston wedge 98 having horizontal and vertical components and imparts it to the diverter end wedge 94'. As the sliding wedge 112 continues sliding, the diverter end wedge 94' and sliding diverter wedge 146 slip relative to each other such that the diverter end portion 92' pivots upward about the pivot axis Y'. When the pivoting pedal 108 is again returned to the up position, the sliding wedge 112 slides away from the diverter end portion 92' under the tension force of the sliding wedge biasing spring 114 such that the sliding diverter wedge 146 and diverter end wedge 94' disengage and the diverter end portion 92' pivots downwards due to the tension force of the diverter biasing spring 58' shown in FIG. 6. The movement of the pivoting pedal 108, sliding wedge 112 and diverter end portion 92' are schematically illustrated by arrows 148. It will be understood that the biasing springs may have spring rates that are optimized to overcome all resistive forces such as friction, weight and spring tension in order to provide for upward and downward movement of the diverter end portion 92' when pivoting pedal 108 is in the down or up position respectively.

The operation of the diverter assembly 50 will now be described with respect to the base unit 14 shown in FIGS. 2-5. However, it is noted that the diverter assembly 50' of the base unit 14' shown in FIGS. 6-8 operates in a similar manner, and so the following description of FIGS. 9-12 also applies.

Figure 9:
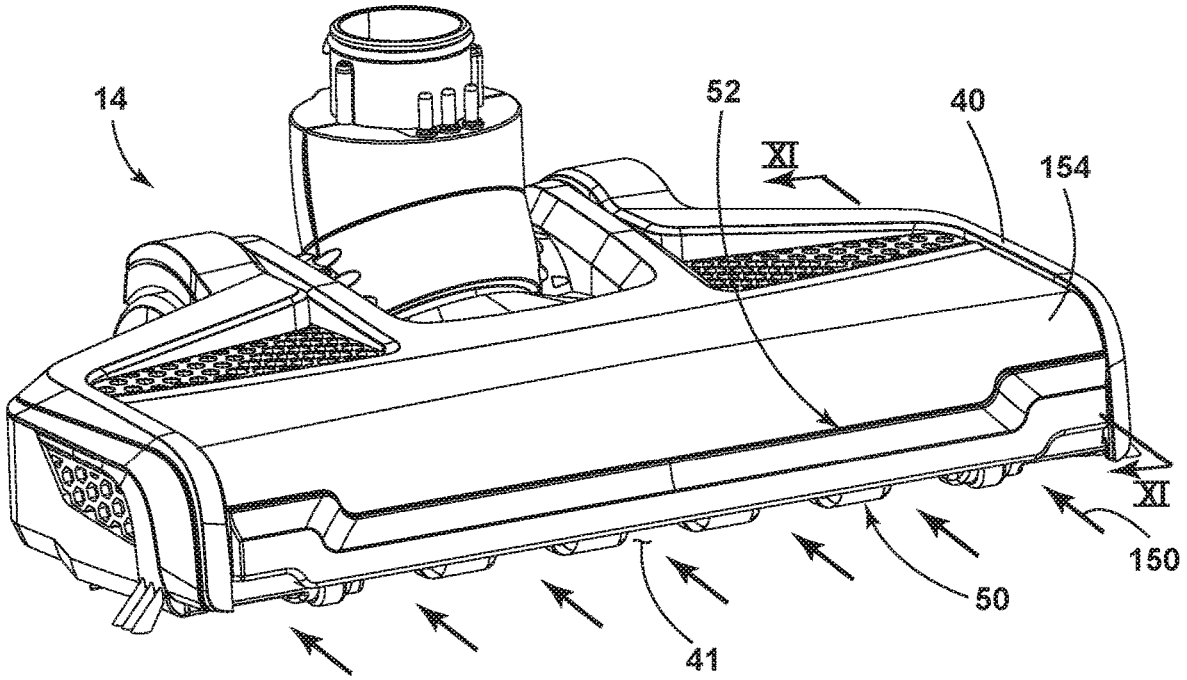
FIG. 9 is a perspective view of the base unit 14 of FIG. 2 with the diverter member in a down position.

FIG. 9 shows a perspective view of the base unit 14 with the diverter member 52 in an up position. The base housing 40 may further include a diverter recess 152 (best seen in FIG. 10) configured to receive the diverter member 52 such that the base housing front portion 154 is flush with the front surface of the diverter member 52 as shown. During operation, the diverter member 52 in the up position allows debris laden air to be drawn into the base unit 14 through the front suction nozzle opening 41 along the entire length of the diverter member 52 as indicated by arrows 150.

Figure 10:
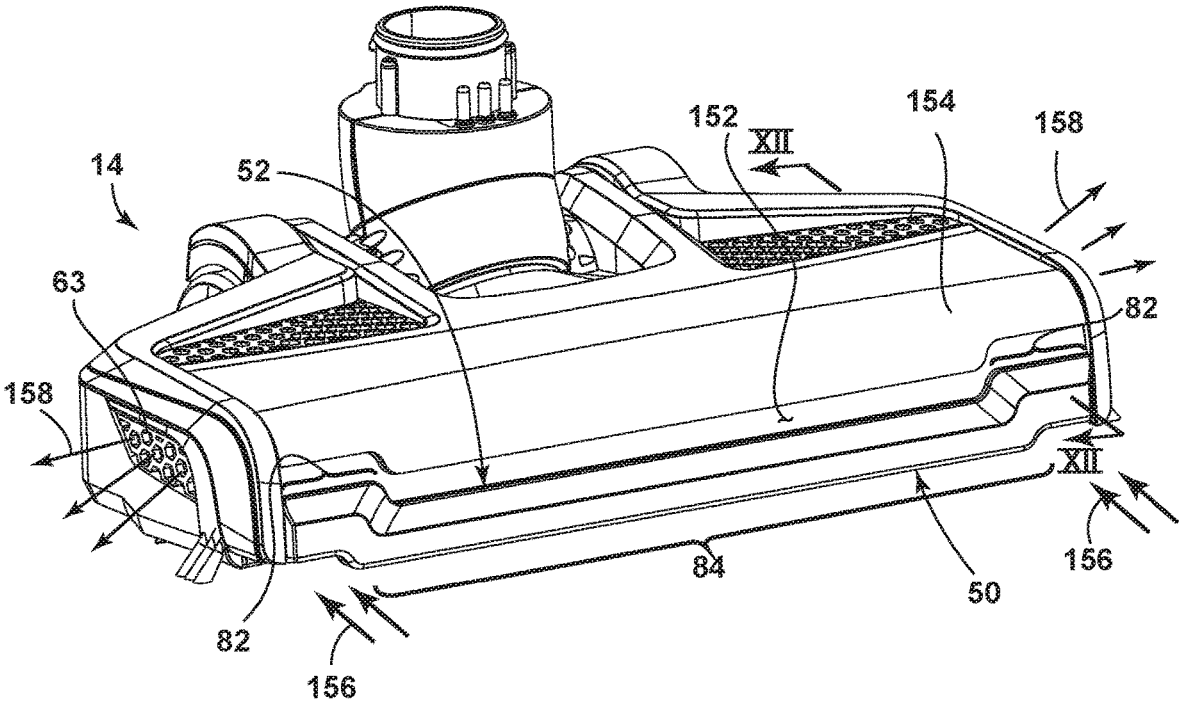
FIG. 10 is a is a perspective view of the base unit 14 of FIG. 2 with the diverter member in an up position.

FIG. 10 shows a perspective view of the base unit 14 with the diverter member 52 in a down position. When in the diverter member 52 is in the down position the edge illuminators 60 (FIG. 3) are energized such that light illuminated from the edge illuminators 60 passes through the light transmitting screens 63 as indicated by arrows 158. During operation when the diverter member 52 is in the down position, the diverter member middle 84 restricts a portion of the front suction nozzle opening 41 such that debris laden air may only be drawn into the base unit 14 through the unrestricted portions of the front suction nozzle opening 41 disposed under the diverter member ends 82 as illustrated by arrows 156. The restricted portion of the front suction nozzle opening 41 increases the suction in the unrestricted portions such that suction is focused, resulting in a higher velocity airstream created in the area under the diverter member ends 82 than when the diverter member 52 is in the up position as shown in FIG. 9.

Figure 11:
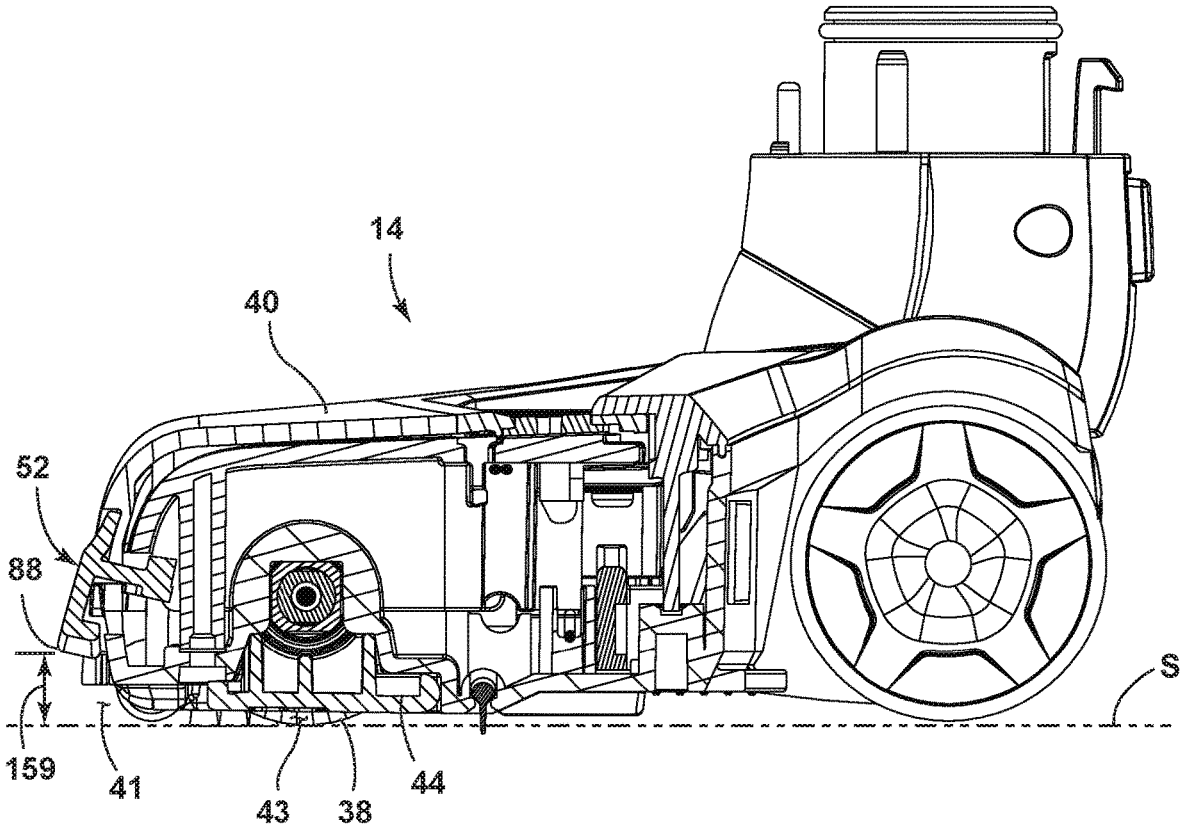
FIG. 11 is a cross-sectional view through line XI-XI of FIG. 9.
Figure 12:
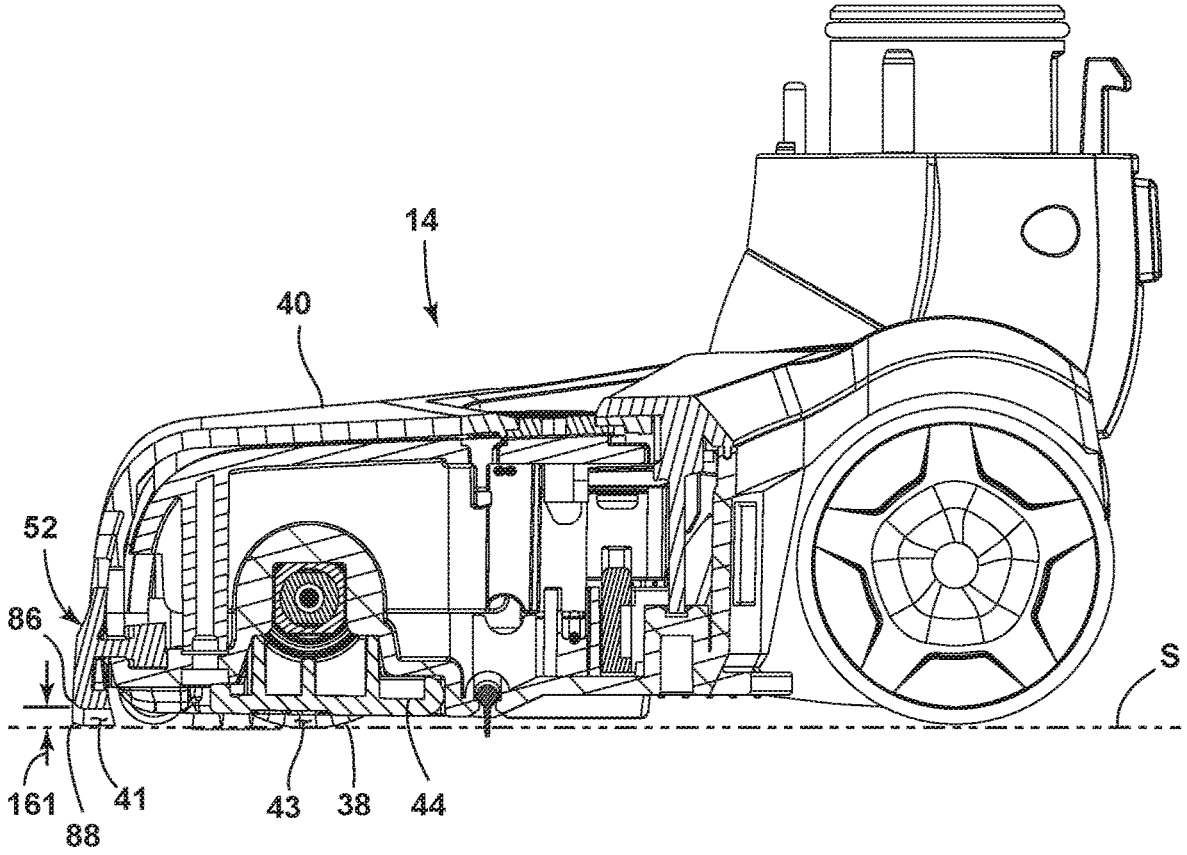
FIG. 12 is a cross-sectional view through line XII-XII of FIG. 10.

FIG. 11 shows the front suction nozzle opening 41 having an open height 159 defined by the height between the surface to be cleaned S and the diverter member 52 middle portion bottom edge 88. When in the down position as shown in FIG. 12 it can be seen the middle portion bottom edge 88 abuts the surface to be cleaned S such that a closed height 161 of the front suction nozzle opening 41, defined by the height between the surface to be cleaned S and the diverter member 52 end portion bottom edge 86, is smaller than that of the open height 159 shown in FIG. 11.

It is noted that, regardless of the position of the diverter assembly 50, i.e. regardless of whether the front suction nozzle opening 41 is unrestricted or partially restricted by the diverter member 52, the underside suction nozzle opening 43 formed in the underside of the sole plate 44 may remain open to allows debris laden air to be drawn into the base unit 14 through the underside suction nozzle opening 43. The bristles of the agitator 38 can project through the underside suction nozzle opening 43 to agitator debris on the surface to be cleaned.

Figure 13:
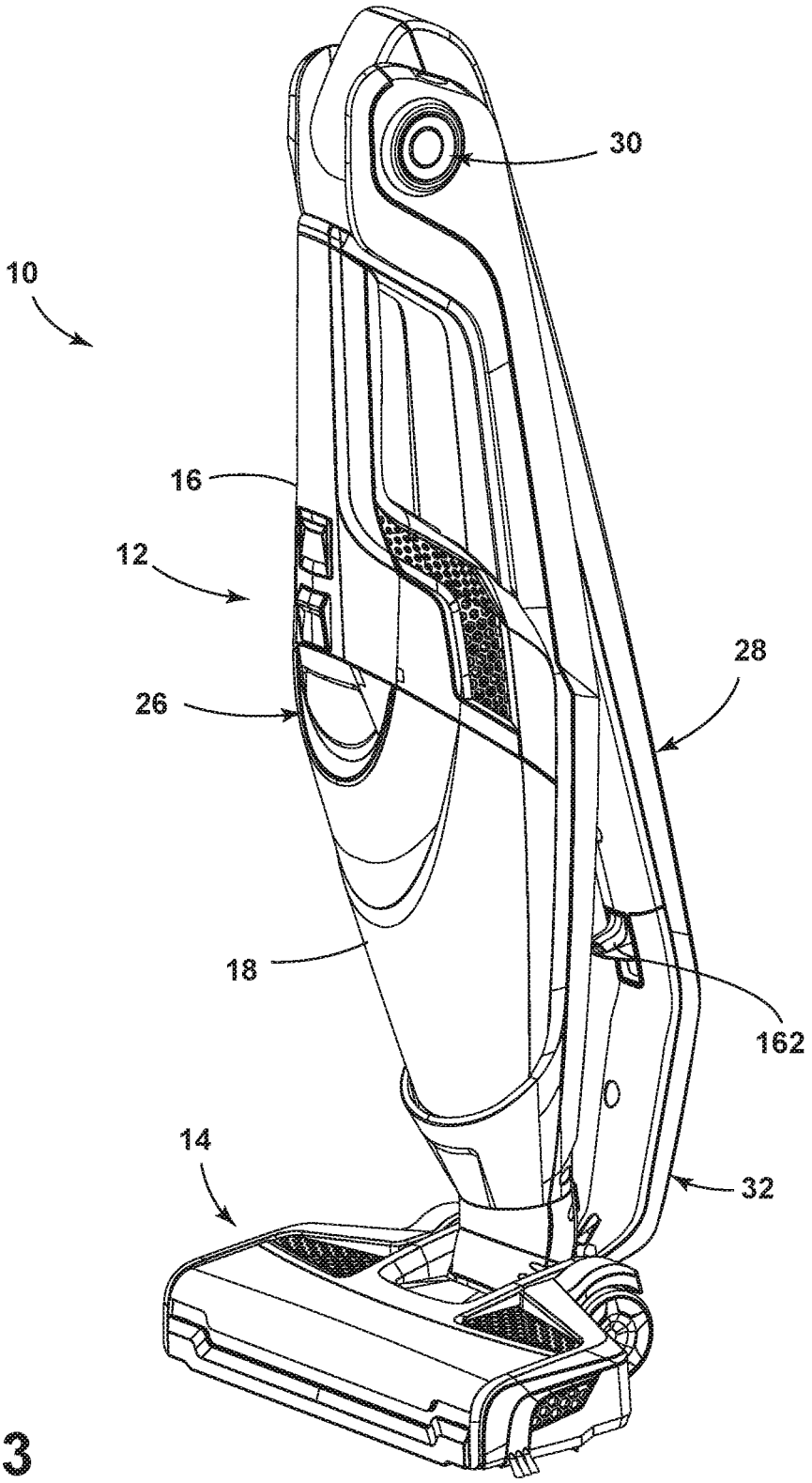
FIG. 13 is a perspective view of the vacuum cleaner of FIG. 1 with the handle in the folded position.

Referring now to FIGS. 2 and 13, another aspect of the present disclosure relates to the pivoting handle 28 of the vacuum cleaner 10. The handle 28 is selectively pivotable between an upright position as shown in FIG. 2 and a folded position as shown in FIG. 13. A trigger 162 disposed on the rear of the handle 28 is operably coupled to the handle coupler 30 so as to selectively allow the handle 28 to be pivoted about the handle coupler 30. The trigger is configured to be linearly movable to and from an unlocked pivoting position by a user pulling the trigger 162 upwards. When the trigger 162 is in the locked position, the handle 28 is locked in the upright position as shown in FIG. 2. When the trigger 162 is in the unlocked pivoting position, the handle 28 may pivot to a folded position as shown in FIG. 13. It is noted that a vacuum cleaner having the pivoting handle 28 described herein may be combined with either base unit 14, 14', or may be provided with a different vacuum cleaner base.

Figure 14:
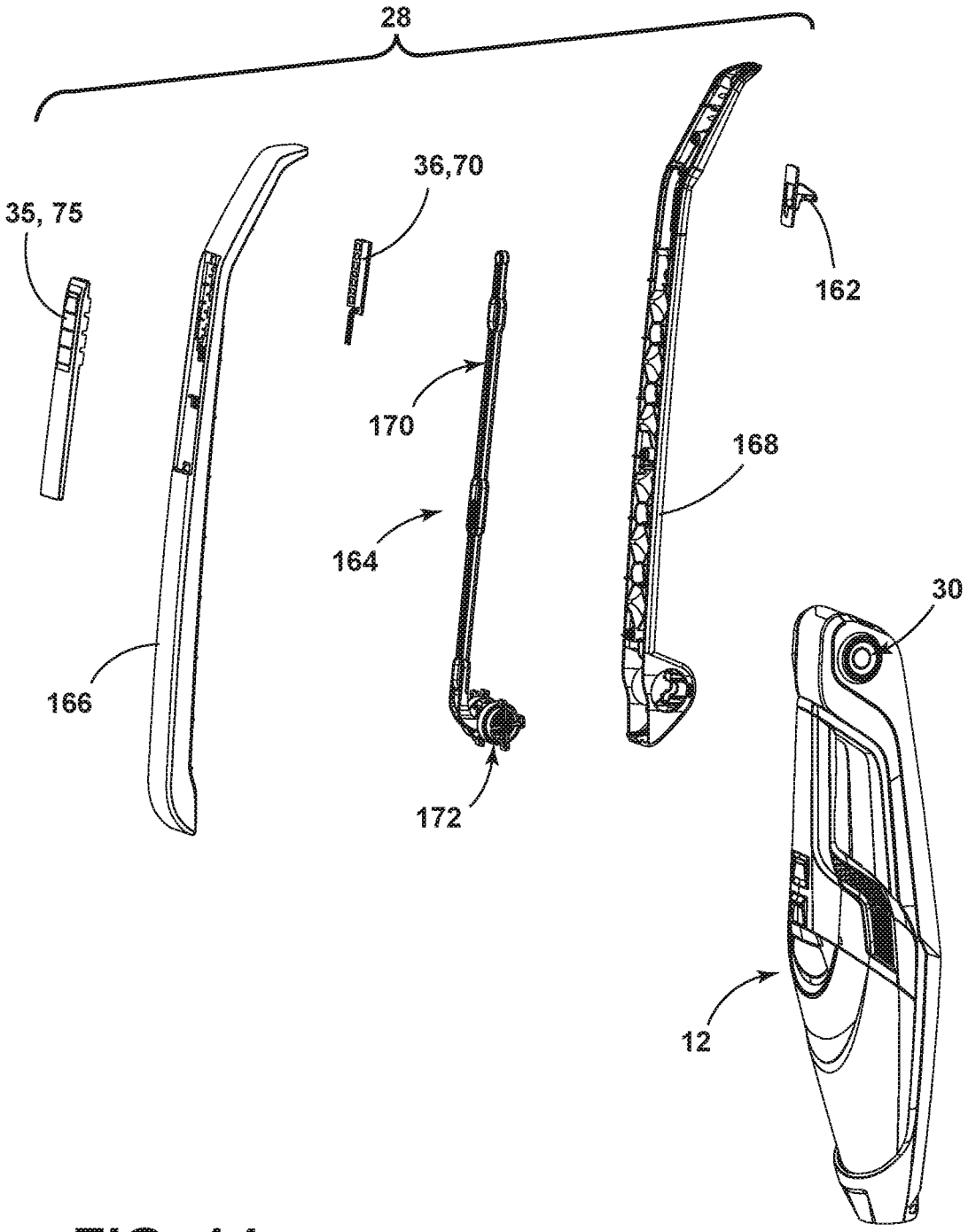
FIG. 14 is an exploded view of the vacuum cleaner handle of FIG. 2.

FIG. 14 shows an exploded view of the handle 28. The handle 28 comprises a front casing 166, a rear casing 168, an interlocking assembly 164 forming a portion of the handle coupler 30, buttons 35, 75, their associated switches 36, 70, and the trigger 162. The interlocking assembly 164 comprises a trigger shaft 170 connected to an interlocking mechanism 172 and is disposed within the front casing 166 and rear casing 168. A portion of the trigger 162 passes through the rear casing 168 and couples to the upper end of the trigger shaft 170. A portion of the interlocking mechanism 172 couples to the upper unit 12 to form the handle coupler 30.

Figure 15:
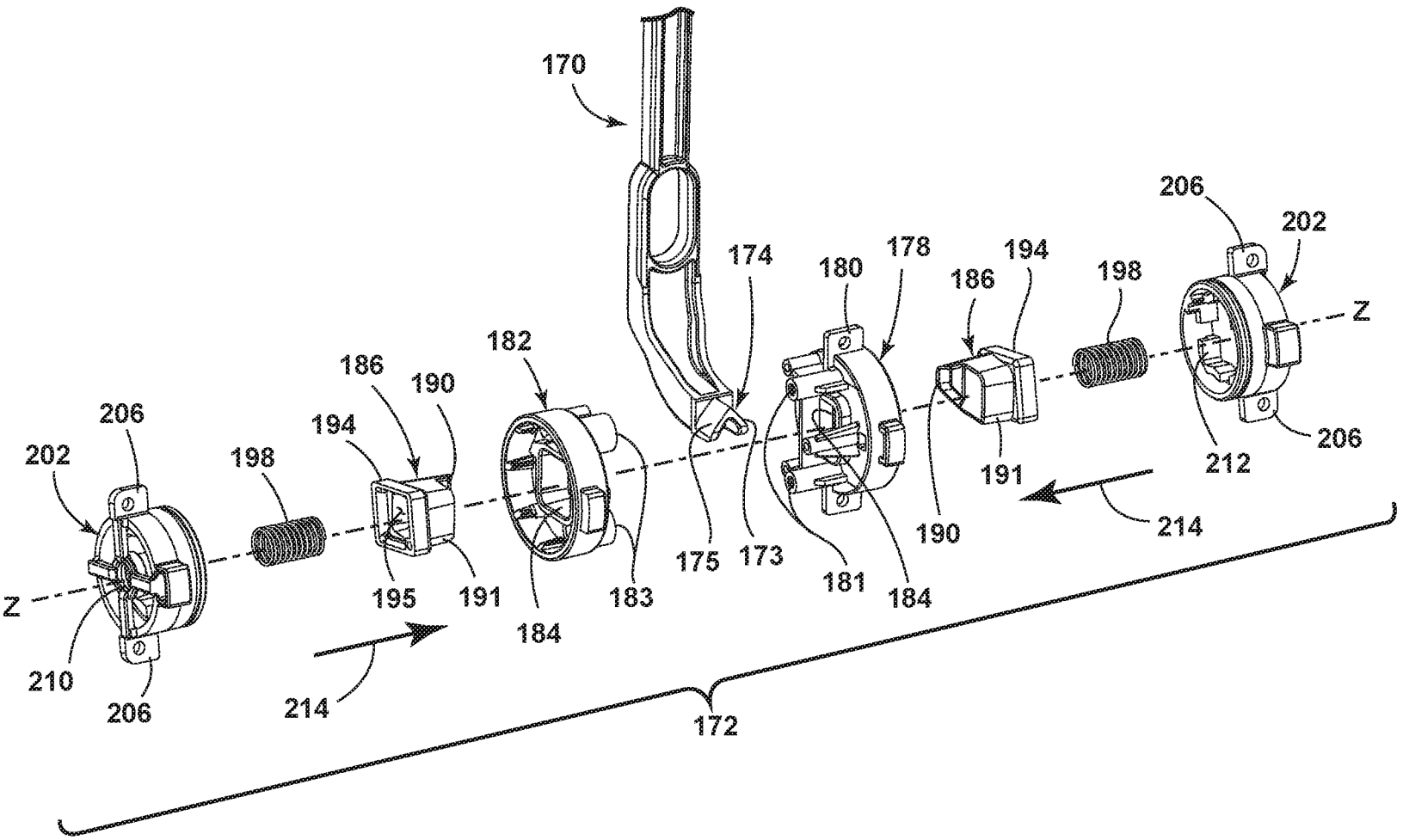
FIG. 15 is an exploded view of the interlocking assembly of FIG. 14.

FIG. 15 shows an exploded view of the interlocking mechanism 172 and the lower portion of the trigger shaft 170. The lower portion of the trigger shaft 170 includes a shaft wedge 174 having bisecting inclined walls 173, 175 sloping away from each other and extending perpendicular to a vertical portion of the trigger shaft 170. The interlocking mechanism 172 comprises a first and second pivoting handle mount 178, 182, two interlock members 186, two retention springs 198 and two upper unit stationary mounts 202.

The first and second pivoting handle mounts 178, 182 form generally cylindrical bodies having interior and exterior features and comprise circular locking projections 181, 183, wherein the locking projections 181 on the first pivoting handle mount 178 are configured to be coaxially received by the locking projections 183 on the second pivoting handle mount 182. The first and second pivoting handle mount 178, 182 further comprise a rectangular sleeve 184 configured to receive the two interlock members 186. The first pivoting handle mount 178 further comprises handle mounting flanges 180 that attach to the rear casing 168 (FIG. 14).

The two interlocking members 186 each comprise a wedge protrusion 190, a male locking connector 194 opposing the wedge protrusion 190, a rectangular middle portion 191 and a void 195 configured to receive the retention spring 198.

The two upper unit stationary mounts 202 form generally cylindrical bodies having interior and exterior features and comprise a spring retainer 210 configured to retain the two retention springs 198, upper unit mounting flanges 206, configured to attach to the upper unit 12 (FIG. 14) and a rectangular female locking connector 212 disposed on the interior of the two upper unit stationary mounts 202 configured to selectively receive the male locking connectors 194.

Figure 16:
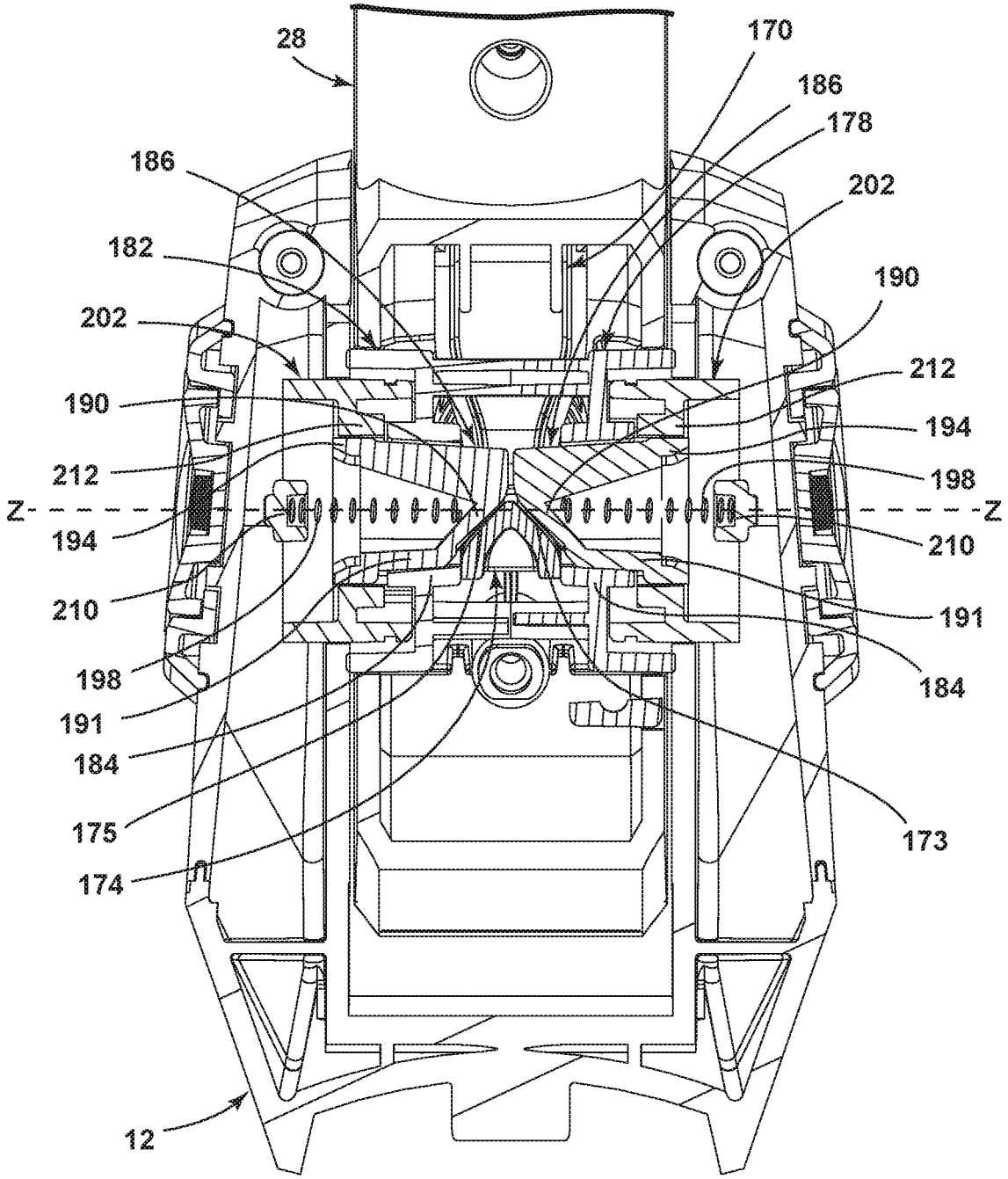
FIG. 16 is a cross-sectional view through line XVI-XVI of FIG. 2 with the trigger not in a locked position.

FIG. 16 shows a cross sectional view of FIG. 2 taken along line XVI-XVI with the trigger 162 (FIG. 14) in the locked position. The different components of the interlocking mechanism assemble together along a handle pivot axis Z as indicated by assembly arrows 214 shown in FIG. 15. The two upper unit stationary mounts 202 and first and second pivoting handle mounts 178, 182 assemble together such that a portion of the exterior of two upper unit stationary mounts 202 are received by a portion of the interior of the first and second pivoting handle mounts 178, 182. The retention springs 198 are retained between the two upper unit stationary mounts 202 and the two interlocking members 186. The two interlocking members 186 are retained between the two upper unit stationary mounts 202 and the first and second pivoting handle mounts 178, 182 such that the male locking connectors 194 are received by the female locking connectors 212 and the wedge protrusions 190 are in communication with the bisecting inclined walls 173, 175 of the shaft wedge 174. The interlocking members 186 are coupled to the first and second pivoting handle mount 178, 182 by the rectangular middle portion 191 received in the rectangular sleeves 184 and the male locking connectors 194 engage the female locking connectors 212 to prevent rotation of the interlocking members 186, therefore the first and second pivoting handle mounts 178, 182 are prevented from pivoting as well.

Figure 17:
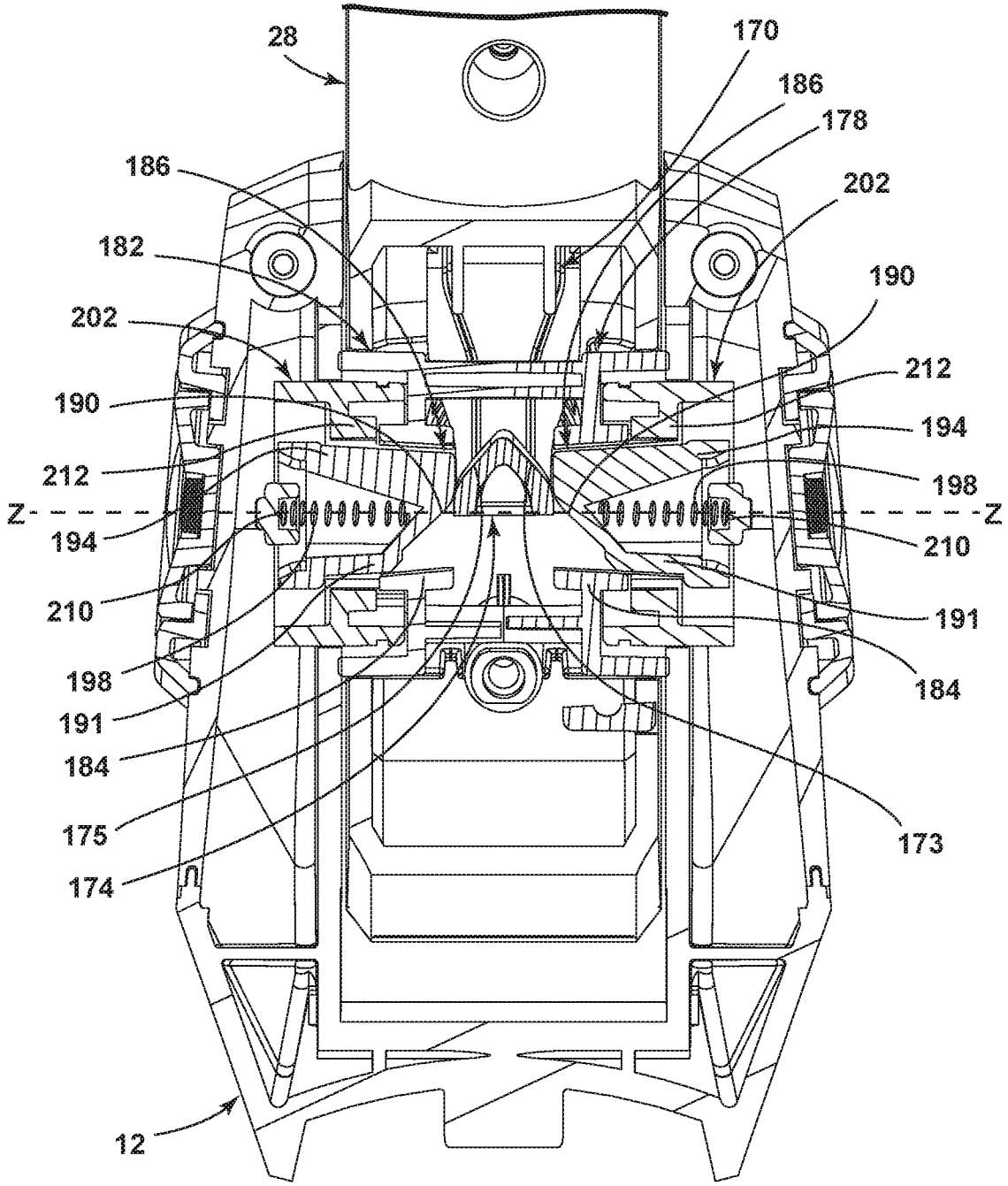
FIG. 17 is a cross-sectional view through line XVI-XVI of FIG. 2 with the trigger in an unlocked pivoting position.

FIG. 17 shows a cross sectional view of FIG. 2 taken along line XVI-XVI with the trigger 162 (FIG. 14) in the unlocked pivoting position. When the trigger 162 (FIG. 14) is in the unlocked pivoting position, the trigger shaft 170 and shaft wedge 174 move upwards. The bisecting inclined walls 173, 175 exert a force perpendicular to the bisecting inclined walls 173, 175, having horizontal and vertical components, and impart the movement to the wedge protrusions 190 of the interlocking members 186. As the trigger shaft 170 and shaft wedge 174 move upwards, the bisecting inclined walls 173, 175 and wedge protrusions 190 slip relative to each other such that the interlocking members 186 move outward towards the spring retainers 210 until the male locking connectors 194 disengage the rectangular female locking connectors 212. Once disengaged, the interlocking members 186 are free to rotate relative to the two upper unit stationary mounts 202 while still being coupled to the first and second pivoting handle mount 178, 182 connected to the handle 28. Therefore, the trigger shaft 170, first and second pivoting handle mount 178, 182 and interlocking members 186 all rotate together with the handle 28, while the two upper unit stationary mounts 202 connected to the upper unit 12 do not pivot.

When the handle is returned to the upright position as shown in FIG. 2 and the trigger 162 is in the locked position, the retention springs 198 move the interlocking members 186 towards the shaft wedge 174 such that the male locking connectors 194 engage the rectangular female locking connectors 212 and rotation of the handle 28 is prevented. It will be understood the retention springs 198 may have a spring rate that is optimized to along for disengaging movement the interlocking members 186 by a user linearly moving the trigger 162 and to overcome all resistive forces such as friction and weight in order to provide for engaging movement of the interlocking members 186. It is contemplated that the trigger shaft 170 can optionally be configured to actuate one or more additional interlocking members 186 to provide increased strength of the interlocking mechanism 172 and increased torsional stiffness at the handle coupler 30 joining the handle 28 to the upper unit 12. The at least one additional locking member (not shown) can function in a substantially similar way as the previously disclosed locking member 186, but can comprise an alternate structure, such as a cylindrical pin, for example The vacuum cleaner 10 disclosed herein provides improved cleaning performance and ease of use. One advantage that may be realized in the practice of some embodiments of the described vacuum cleaner 10 is that the vacuum cleaner 10 can be configured to selectively provide increased suction to the edges of the suction nozzle 42 so as to increase cleaning potential along edges and walls. Furthermore, the edges or walls to be cleaned may be automatically illuminated to increased user visibility by the user. Another advantage is that the vacuum cleaner 10 can be configured such that the handle 28 may be easily folded by a simple pull of the trigger 162 by a user.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus, comprising:

a base unit configured to be moved over a surface to be cleaned;

an upper unit coupled with the base unit;

a handle coupled with the upper unit and configured for use in facilitating movement of the surface cleaning apparatus over the surface to be cleaned;

a handle coupler pivotally coupling a proximal end of the handle with the upper unit and defining a single pivot point, the handle coupler adapted for selective movement of the handle about a horizontal axis defined by the single pivot point of the handle coupler between an upright position and a folded position wherein at least a portion of the handle confronts a portion of the upper unit, and where the handle coupler is moveable between a first position to allow the handle to rotate about the horizontal axis into the folded position and a second position to lock the handle in the upright position;

an actuator located remotely from the handle coupler and operably coupled to the handle coupler and moveable between a locked position where the handle is locked in the upright position and an unlocked pivoting position where the handle remains released to the folded position wherein at least a portion of the handle directly confronts a portion of the upper unit; and an interlocking assembly, including at least one interlock member horizontally slidable by the actuator to an unlocked position when the actuator is moved to the unlocked pivoting position, the interlocking assembly configured to lock the handle in the upright position when the handle coupler is in the second position and the actuator is in a locked position.

2. The surface cleaning apparatus of claim 1 wherein the actuator is located on a body of the handle spaced from the proximal end of the handle.

3. The surface cleaning apparatus of claim 2 wherein the actuator is disposed on a rear of the handle.

4. The surface cleaning apparatus of claim 2 wherein the actuator is a linearly moveable actuator.

5. The surface cleaning apparatus of claim 4 wherein the actuator is a trigger.

6. The surface cleaning apparatus of claim 1 wherein the interlocking assembly includes a first pair of mounts coupled to the upper unit and a second pair of mounts coupled with the handle and configured to selectively rotate relative to the first pair of mounts when the handle coupler is in the first position.

7. The surface cleaning apparatus of claim 6 wherein when the handle coupler is in the second position, the second pair of mounts is inhibited from rotating relative to the first pair of mounts.

8. The surface cleaning apparatus of claim 6 wherein the interlocking assembly includes at least one interlock member, wherein:

when the handle coupler is in the second position, the at least one interlock member engages an adjacent one of the first pair of mounts and inhibits rotation of at least one of the second pair of mounts relative to the first pair of mounts; and when the handle coupler is in the first position, the at least one interlock member is disengaged from the adjacent one of the first pair of mounts and releases the at least one of the second pair of mounts for rotation relative to the first pair of mounts.

9. The surface cleaning apparatus of claim 8 wherein the handle coupler includes an actuating member operably coupled to the actuator and where engagement of the actuator is configured to selectively move the at least one interlock member to disengage the at least one interlock member from the adjacent one of the first pair of mounts to move the handle coupler into the first position.

10. The surface cleaning apparatus of claim 9 wherein the actuator and the actuating member are coupled by a shaft that is linearly moveable relative to the handle.

11. The surface cleaning apparatus of claim 9 wherein the handle coupler includes a pair of interlock members and wherein when the handle coupler is in the second position, each of the pair of interlock members engages an adjacent one of the first pair of mounts and inhibits rotation of at least one of the second pair of mounts relative to the first pair of mounts.

12. A surface cleaning apparatus, comprising:

a base unit comprising a suction nozzle, the base unit configured to be moved over a surface to be cleaned;

an upper unit comprising a suction source in fluid communication with the suction nozzle, the upper unit coupled with the base unit;

a handle coupled with the upper unit and configured for use in facilitating movement of the surface cleaning apparatus over the surface to be cleaned;

a handle coupler pivotally coupling a proximal end of the handle with the upper unit for selective movement of the handle about a horizontal axis defined by the handle coupler between an upright position and a folded position where the handle coupler is moveable between a first position to allow the handle to rotate about the horizontal axis into the folded position and a second position to lock the handle in the upright position;

an actuator operably coupled to the handle coupler and disposed on the handle at a location spaced from the proximal end of the handle, the actuator accessible by a user of the surface cleaning apparatus for selectively moving the handle coupler between the first and second positions; and an interlocking assembly, including a pair of interlock members moved horizontally to an unlocked position by the actuator, the interlocking assembly configured to lock the handle in the upright position when the handle coupler is in the second position and the actuator is in a locked position and selectively release the handle to the folded position wherein at least a portion of the handle directly confronts a portion of the upper unit and the actuator is in an unlocked pivoting position.

13. The surface cleaning apparatus of claim 12 wherein the actuator is a linearly moveable trigger disposed on a rear of the handle.

14. The surface cleaning apparatus of claim 12, wherein the interlocking assembly includes a first pair of mounts coupled to the upper unit and a second pair of mounts coupled with the handle and configured to selectively rotate relative to the first pair of mounts when the handle coupler is in the first position.

15. The surface cleaning apparatus of claim 14 wherein when the handle coupler is in the second position, the second pair of mounts is inhibited from rotating relative to the first pair of mounts.

16. The surface cleaning apparatus of claim 15 wherein when the handle coupler is in the second position, each of the pair of interlock members engages an adjacent one of the first pair of mounts and inhibits rotation of at least one of the second pair of mounts relative to the first pair of mounts.

17. The surface cleaning apparatus of claim 16 wherein the actuator is connected to the handle coupler via a shaft that is configured to move a shaft wedge to disengage each of the pair of interlock members from an adjacent one of the first pair of mounts when the handle coupler is moved to the first position.

18. A surface cleaning apparatus, comprising:

a base unit configured to be moved over a surface to be cleaned;

an upper unit coupled with the base unit;

a handle coupled with the upper unit and configured for use in facilitating movement of the surface cleaning apparatus over the surface to be cleaned;

a handle coupler pivotally coupling a proximal end of the handle with the upper unit for selective movement of the handle about a horizontal axis defined by the handle coupler between an upright position and a folded position where the handle coupler is moveable between a first position to allow the handle to rotate about the horizontal axis into the folded position and a second position to lock the handle in the upright position; and an actuator located on a body of the handle spaced from the proximal end of the handle and operably coupled to the handle coupler, the actuator configured to allow the handle coupler to move to the first position and where the actuator is located remotely from the handle coupler;

wherein the handle further comprises:

an interlocking assembly configured to lock the handle in the upright position when the handle coupler is in the second position and the actuator is in a locked position and selectively release the handle when the handle coupler is in the first position and the actuator is in an unlocked pivoting position, the interlocking assembly comprising:

a first pair of mounts coupled to the upper unit;

a second pair of mounts coupled with the handle and configured to selectively rotate relative to the first pair of mounts when the handle coupler is in the first position;

at least one interlock member, wherein:

when the handle coupler is in the second position, the at least one interlock member engages an adjacent one of the first pair of mounts and inhibits rotation of at least one of the second pair of mounts relative to the first pair of mounts; and when the handle coupler is in the first position, the at least one interlock member is disengaged from the adjacent one of the first pair of mounts and releases the at least one of the second pair of mounts for rotation relative to the first pair of mounts; and an actuating member operably coupled to the actuator and where engagement of the actuator is configured to selectively move the at least one interlock member to disengage the at least one interlock member from the adjacent one of the first pair of mounts to move the handle coupler into the first position; and wherein the actuating member moves the at least one interlock member along the horizontal axis to disengage the at least one interlock member from the adjacent one of the first pair of mounts to move the handle coupler into the first position.

19. The surface cleaning apparatus of claim 18 wherein the handle coupler includes a biasing member to bias the at least one interlock member into engagement with the adjacent one of the first pair of mounts.

* * * * *